US008190051B2

(12) United States Patent
Sano et al.

(10) Patent No.: US 8,190,051 B2
(45) Date of Patent: May 29, 2012

(54) CLEANING DEVICE FOR INTERMEDIATE TRANSFERRING MEMBER AND IMAGE-FORMING APPARATUS EQUIPPED WITH THE SAME

(75) Inventors: Tetsuo Sano, Toyokawa (JP); Junpei Shouno, Kawasaki (JP); Hirofumi Nakagawa, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 205 days.

(21) Appl. No.: 12/639,418

(22) Filed: Dec. 16, 2009

(65) Prior Publication Data

US 2010/0150602 A1 Jun. 17, 2010

(30) Foreign Application Priority Data

Dec. 16, 2008 (JP) ..... 2008-319914

(51) Int. Cl.
*G03G 15/16* (2006.01)

(52) U.S. Cl. ..... 399/101; 399/354; 399/357

(58) Field of Classification Search ..... 399/71, 399/98, 99, 101, 121, 123, 343, 349, 353, 399/354, 357
See application file for complete search history.

(56) References Cited

U.S. PATENT DOCUMENTS

| | | | |
|---|---|---|---|
| 7,433,626 | B2 | 10/2008 | Takeuchi |
| 2002/0197082 | A1 | 12/2002 | Hosokawa et al. |
| 2005/0265745 | A1 | 12/2005 | Takesawa et al. |

FOREIGN PATENT DOCUMENTS

| | | | |
|---|---|---|---|
| JP | 01-198784 | | 8/1989 |
| JP | 07-325461 | | 12/1995 |
| JP | 2000-320536 | | 11/2000 |
| JP | 2002-229344 | A | 8/2002 |
| JP | 2002-318484 | | 10/2002 |
| JP | 2005-221537 | | 8/2005 |
| JP | 2005221537 | A * | 8/2005 |

(Continued)

OTHER PUBLICATIONS

Office Action (Preliminary Notice of Rejection) dated Oct. 26, 2010, issued in the corresponding Japanese Patent Application No. 2008-319914, and an English Translation thereof.

(Continued)

*Primary Examiner* — Mark R Gaworecki
(74) *Attorney, Agent, or Firm* — Buchanan Ingersoll & Rooney PC

(57) ABSTRACT

A cleaning device for an intermediate transferring member, comprising:

a first cleaning roller that is placed so as to rotate while being made in contact with a surface of the intermediate transferring member;

a first bias-applying device that applies a bias voltage to the first cleaning roller;

a second cleaning roller that is placed so as to rotate while being made in contact with the surface of the intermediate transferring member on a downstream side from the first cleaning roller in a surface-moving direction of the intermediate transferring member; and a second bias-applying device that applies a bias voltage having a polarity different from that of the bias voltage applied by the first bias-applying device to the second cleaning roller, wherein the first cleaning roller is a brush roller, and the second cleaning roller is a foam roller having a foam layer on a surface thereof, with a cell wall face in the foam layer having an opening ratio in a range of 3% or more to 50% or less, and an image-forming apparatus equipped with said cleaning device for an intermediate transferring member.

14 Claims, 5 Drawing Sheets

FOREIGN PATENT DOCUMENTS

| | | |
|---|---|---|
| JP | 2005-308894 | 11/2005 |
| JP | 2005-338492 | 12/2005 |
| JP | 2007-248921 | 9/2007 |
| JP | 2007-272091 | 10/2007 |

OTHER PUBLICATIONS

Office Action (Preliminary Notice of Rejection) dated Jun. 7, 2011, issued in the corresponding Japanese Patent Application No. 2008-319914, and an English Translation thereof.

* cited by examiner

CLEANING DEVICE FOR INTERMEDIATE TRANSFERRING MEMBER AND IMAGE-FORMING APPARATUS EQUIPPED WITH THE SAME

This application is based on application No. 2008-319914 filed in Japan, the contents of which are hereby incorporated by reference.

BACKGROUND OF THE INVENTION

1. Field of the Invention

The present invention relates to a cleaning device for cleaning an intermediate transferring member in an image-forming apparatus, such as a copying machine, a facsimile and a laser printer, of an electro-photographic system that forms monochrome images or color images, and an image-forming apparatus provided with such a cleaning device.

2. Description of the Related Art

The intermediate transferring member is a member that is used for holding a toner image primarily transferred from a surface of a photosensitive member onto its surface, and allowing the image to be secondarily transferred on a recording medium such as a sheet of paper after transporting the toner image in an image-forming apparatus. Since objects to be cleaned such as residual toner, toner external additives, powder of recording medium and filling materials of recording medium, are present on the surface of the intermediate transferring member, the image-forming apparatus is provided with a cleaning device for cleaning and removing the objects to be cleaned from the surface of the intermediate transferring member.

As such a cleaning device, for example, Japanese Patent Application No. 2002-229344 has proposed an intermediate transferring belt cleaning device as shown in FIG. 6. More specifically, the device includes a first cleaning brush 151A and a second cleaning brush 151B, and a positive bias voltage is applied to the first cleaning brush 151A and a negative bias voltage is applied to the second cleaning brush 151B. Thus, the negative toner of the residual toner on an intermediate transferring belt 104 is collected by the first cleaning brush, and one portion thereof is positively charged. The positive toner can be cleaned by the second cleaning brush.

However, in the case when an amount of residual negative toner on an intermediate transferring belt increases, the toner, which is neither collected by the first cleaning brush, nor positively charged, increases to cause toner that cannot be collected even by the second cleaning brush. For this reason, by increasing a density of planted brush hairs, contact portions with the toner are increased; however, although cleaning performance is enhanced, the effect was not sufficient. Since the first cleaning brush has a higher possibility of contact with the toner than the second cleaning brush, the toner is retained in the first cleaning brush. As a result, it is not possible to solve the problem of degradation of cleaning performance with time.

In the case when a cleaning operation on the intermediate transferring belt becomes insufficient, such toner retained on the intermediate transferring belt and continuously turned around, and also fixed to the belt (to cause filming) is generated. When the filming occurs, smoothness and conductive property of the belt surface deteriorate, failing to obtain a good transferring function to cause degradation of image quality.

BRIEF SUMMARY OF THE INVENTION

An object of the present invention is to provide a cleaning device that can maintain a good cleaning performance for the intermediate transferring member, and an image-forming apparatus provided with such a cleaning device.

The present invention relates to a cleaning device for an intermediate transferring member, comprising:

a first cleaning roller that is placed so as to rotate while being made in contact with a surface of the intermediate transferring member;

a first bias-applying device that applies a bias voltage to the first cleaning roller;

a second cleaning roller that is placed so as to rotate while being made in contact with the surface of the intermediate transferring member on a downstream side from the first cleaning roller in a surface-moving direction of the intermediate transferring member; and a second bias-applying device that applies a bias voltage having a polarity different from that of the bias voltage applied by the first bias-applying device to the second cleaning roller, wherein the first cleaning roller is a brush roller, and the second cleaning roller is a foam roller having a foam layer on a surface thereof, with a cell wall face in the foam layer having an opening ratio in a range of 3% or more to 50% or less, and an image-forming apparatus equipped with said cleaning device for an intermediate transferring member.

DETAILED DESCRIPTION OF THE INVENTION

The present invention provides a cleaning device for an intermediate transferring member that includes:

a first cleaning roller that is placed so as to rotate while being made in contact with a surface of the intermediate transferring member;

first bias-applying means that applies a bias voltage to the first cleaning roller;

a second cleaning roller that is placed so as to rotate while being made in contact with the surface of the intermediate transferring member on a downstream side from the first cleaning roller in a surface-moving direction of the intermediate transferring member; and second bias-applying means that applies a bias voltage having a polarity different from that of the bias voltage applied by the first bias-applying means to the second cleaning roller, wherein the first cleaning roller is a brush roller, and the second cleaning roller is a foam roller having a foam layer on a surface thereof, with a cell wall face in the foam layer having an opening ratio in a range of 3% or more to 50% or less, and the present invention also relates to an image-forming apparatus equipped with the above cleaning device for intermediated transfer member.

The cleaning device of the present invention can maintain a desirable cleaning performance for an intermediate transfer member for a long period of time.

Figure 1:
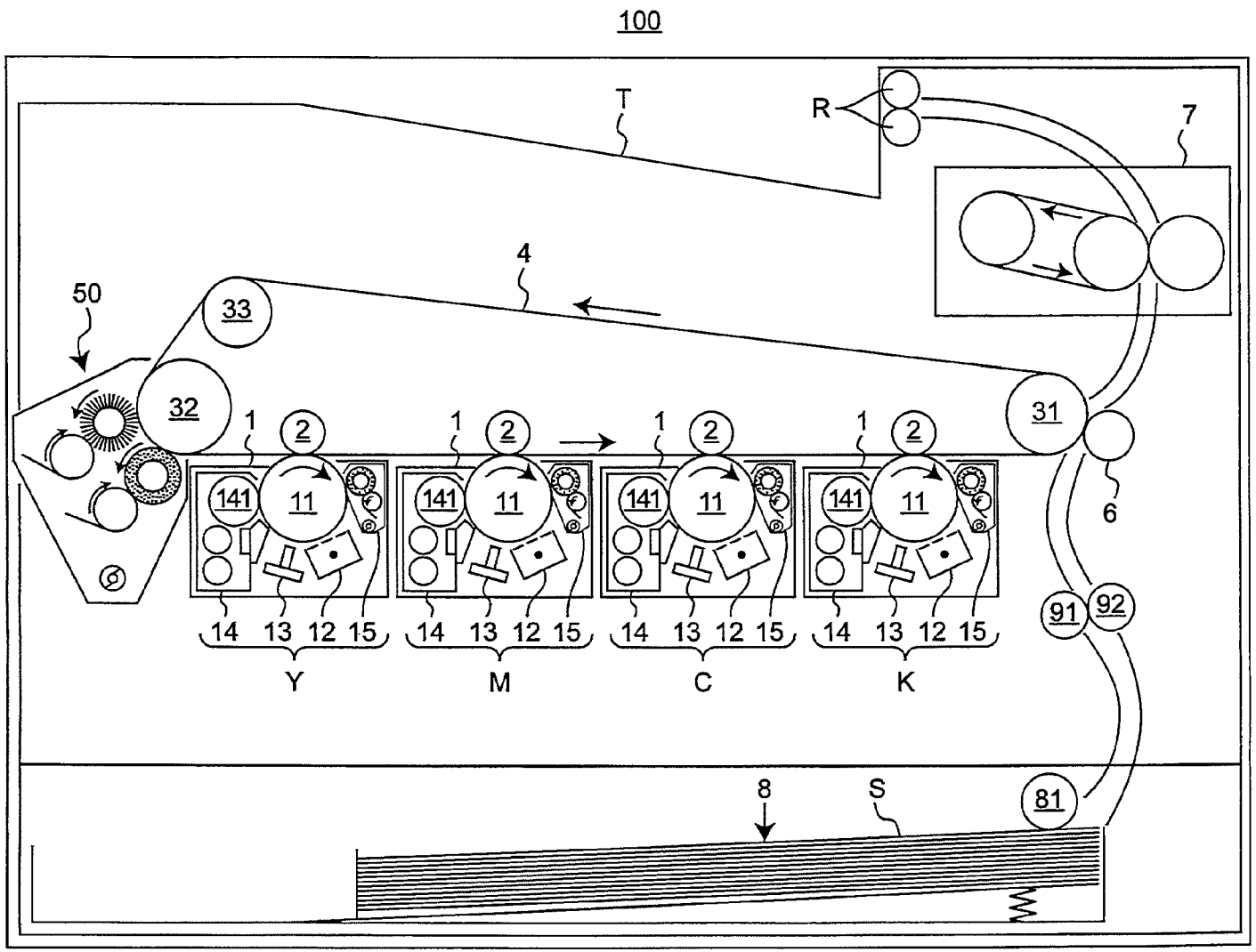
FIG. 1 is a schematic configuration view showing one embodiment of an image-forming apparatus of the present invention.

The cleaning device of the present invention is used for cleaning objects to be cleaned, such as residual toner, toner external additives, recording medium powder (paper powder), recording medium filler materials and a carrier (in the case of a two-component developer), which are present on a surface of an intermediate transferring member. With reference to FIG. 1 showing an image-forming apparatus provided with the cleaning device for an intermediate transferring member of the present invention, the cleaning device will be described in detail; however, the image-forming apparatus of the present invention is not limited thereto.

Cleaning Device

Figure 2:
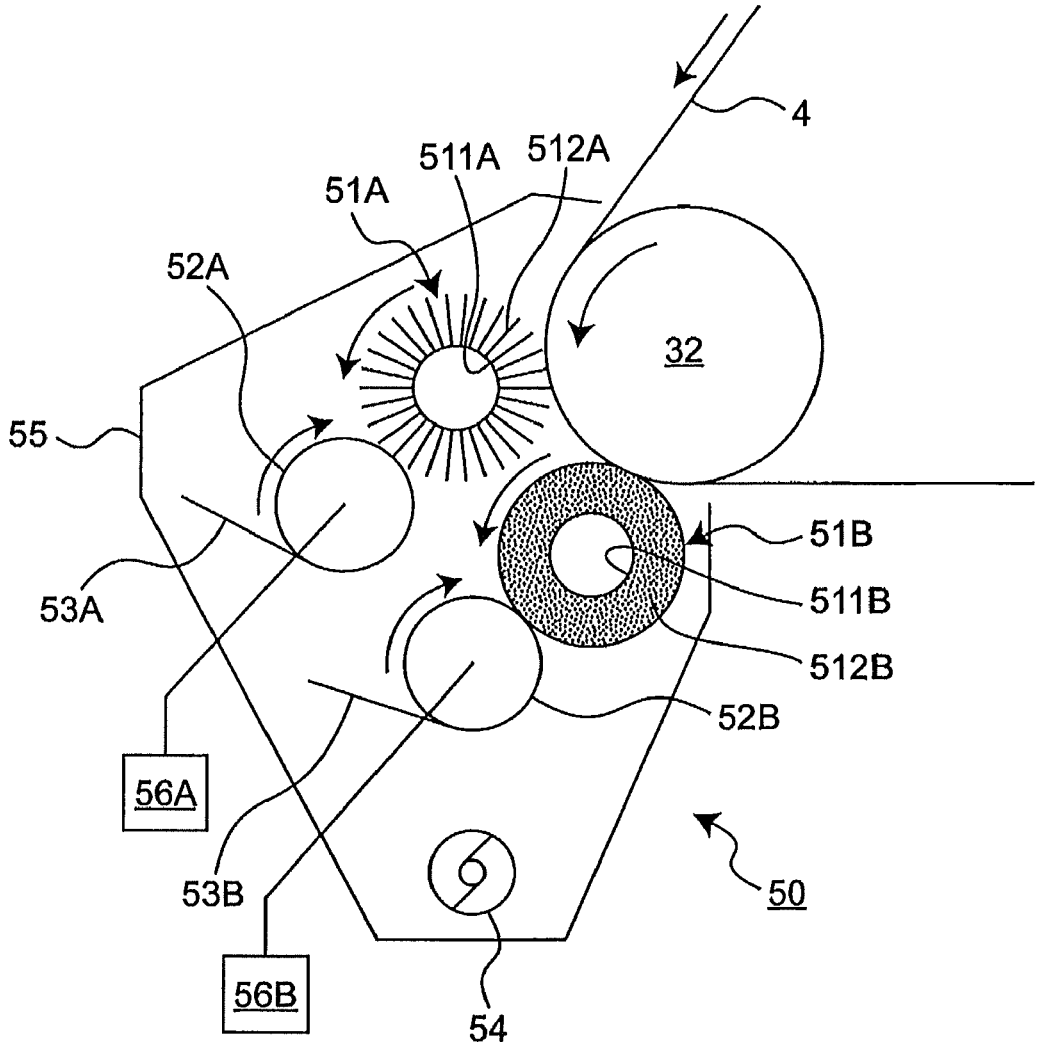
FIG. 2 is an enlarged view showing a cleaning device for an intermediate transferring member in FIG. 1.

FIG. 1 shows a schematic configuration of one embodiment of the image-forming apparatus of the present invention, and FIG. 2 is an enlarged structural view showing the vicinity of a cleaning device 50 for an intermediate transferring member in the image-forming apparatus of FIG. 1.

The cleaning device 50 is installed in a gap between a secondary transferring member 6 and a primary transferring member 2 in an image-forming unit (represented by Y in the present embodiment) located on an uppermost stream side in a surface-moving direction of an intermediate transferring member 4. In FIGS. 1 and 2, the cleaning device 50 is installed over a portion of the intermediate transferring member positioned on a roller 32 on which the intermediate transferring member 4 is wound around. However, the present invention is not limited thereto, and it is only necessary to be installed relative to an intermediate transferring belt on the roller. In FIGS. 1 and 2, the intermediate transferring member 4 has a belt shape; however, it is not necessarily formed into the belt shape, and may have, for example, a drum shape. Hereinafter, description will be made in a case where the intermediate transferring member having a belt shape, that is, the intermediate transferring belt 4, is used.

The intermediate transferring belt 4 is not particularly limited, and may be formed of a resin, such as Teflon (registered trademark), polyester, polyvinylidene fluoride, triacetate, polycarbonate, polyimide and polyphenylene sulfide. Preferably, a conductive material is dispersed in the intermediate transferring belt 4 so as to give a conductive property thereto. In order to improve a transferring property of the toner, and prevent abrasion and scratches, as well as adhesion of foreign matters, onto the surface of the belt, a coat layer may be formed on the belt surface of the intermediate transferring belt 4. For example, rubber, elastomer, resin, glass and the like may be used as the component material of the coat layer. In order to apply a conductive property thereto, a conductive material may be dispersed in the coat layer. For example, known carbon black and metal fine particles, as well as known ion conductive materials, and the like may be used as the conductive material.

A surface resistance value of the intermediate transferring belt 4 is preferably set to about $10^6$ to $10^{12}\Omega/\square$.

The surface resistance value of the intermediate transferring belt 4 can be measured by an ohm meter (Hiresta®; made by Mitsubishi Yukadenshi Co., Ltd.) by using a method in conformity with JIS-K6199.

The cleaning device 50 includes a first cleaning roller 51A disposed so as to be rotatable while being made in contact with the surface of the intermediate transferring belt 4, first bias-applying means 56A for applying a bias voltage to the first cleaning roller, a second cleaning roller 51B, disposed on a downstream side from the first cleaning roller in the surface-moving direction of the intermediate transferring belt, so as to be rotatable while being made in contact with the surface of the intermediate transferring belt 4, and second bias-applying means 56B for applying a bias voltage having a polarity different from that of the bias voltage applied by the first bias-applying means to the second cleaning roller. In an attempt to maintain the cleaning performance for a longer period of time, the cleaning device 50 is preferably provided with a first collecting roller 52A disposed so as to be rotatable while being made in contact with the surface of the first cleaning roller 51A, a first blade 53A that is fixed and disposed while being made in contact with the surface of the first collecting roller 52A, a second collecting roller 52B disposed so as to be rotatable while being made in contact with the surface of the second cleaning roller 51B and a second blade 53B that is fixed and disposed while being made in contact with the surface of the second collecting roller 52B. Generally, the cleaning device 50 may further include a transporting screw 54 that carries out cleaned matters that have been scraped off by the first and second blades 53A and 53B and a sealing member (not shown) used for preventing crushed matters, scattered in a smoke state upon scraping off adhered matters to be cleaned by using the first and second blades 53A and 53B, from adhering again to the intermediate transferring belt 4. These members included in the cleaning device 50 are installed in a case 55 as built-in members in the case 55. One portion of each of the first cleaning roller 51A and the second cleaning roller 51B may be exposed from the case, and be brought in contact with the belt 4. The first cleaning roller 51A, the first collecting roller 52A, the second cleaning roller 51B and the second collecting roller 52B in the cleaning device 50 are respectively driven to rotate independently by instructions given from a control unit Cont (not shown).

In the present invention, the first cleaning roller 51A is a brush roller, and the second cleaning roller 51B is a foam roller, and the cell wall face of the foam layer of the foam roller serving as the second cleaning roller 51B has an opening ratio in a range of 3% or more to 50% or less, preferably 5% or more to 50% or less. With this arrangement, it becomes possible to maintain a good cleaning performance onto the intermediate transferring belt for a long period of time.

Due to contact with a large amount of toner and endurance operations, a brush roller tends to have bent bristles or tangled bristles that cause toner accumulation, and may finally result in an insufficient cleaning operation. When such a brush roller is used as the cleaning roller on the upstream side, uncollected toner that has passed through the upstream side tends to have an unadjusted polarity, or to be left in a state with a strong adhesive force to the belt. In the case when a brush roller is also used on the downstream side, although particles having a polarity different from that of the applied bias voltage can be collected, those charged particles having the same polarity cannot be collected. There may be particles that are transferred without being made in contact with brush fibers, or particles that cannot be scraped even when made in contact therewith. However, in the case when a foam roller is used on the downstream side, since a strong mechanical scraping function is exerted, even charged particles having the same polarity as that of the applied bias voltage can be collected. Further, since a strong adhesive property to the intermediate transferring belt is exerted, even those particles having a strong adhesive force can be scraped off. At the same time, filming can be removed. Furthermore, since the foam layer of the present invention hardly causes toner accumulation, the mechanical toner scraping function and the adhesive property are exerted stably so that it is possible to improve cleaning performance during endurance operations in comparison with the structure in which the brush is used on the downstream side.

By setting the opening ratio of the cell wall face of the foam layer to the above range in the foam roller serving as the second cleaning roller 51B, the foam layer is allowed to have a continuous foam structure near to an independent foam structure. Since the foam layer has such a foam structure, the toner collected from the intermediate transferring belt is not allowed to easily move from a foam cell on the surface to a foam cell inside the roller. Thus, since the toner is kept being located in the vicinity of the surface of the foam roller, it is easily discharged onto the collecting roller so that accumulation of toner hardly occurs. Accordingly, changes in compression hardness and electric resistance of the foam layer become smaller to suppress degradation of foam roller characteristics, making it possible to maintain a stable cleaning performance for a long period of time. In the case when both of the first cleaning roller and the second cleaning roller are brush rollers, toner is retained and accumulated inside the brush roller serving as the first cleaning roller, with the result that the cleaning performance deteriorates during endurance operations. When the opening ratio of the cell wall face of the foam layer is too small, the foam layer comes to form a structure similar to the independent foam structure, with the result that, since an allowable amount of toner collection of the foam roller becomes insufficient, cleaning deficiency of a large amount of toner and degradation of the cleaning performance tend to occur in a comparatively early stage. In the case when the opening ratio of the cell wall face of the foam layer is too large, since the foam layer comes to form a structure similar to the continuous foam structure, the toner is allowed to easily move from the surface foam cells to the foam cells inside the roller during endurance operations. Consequently, it becomes difficult to discharge the toner to the collecting roller, causing the accumulation of toner and comparatively large changes in compression hardness and electric resistance of the foam layer. For this reason, it is not possible to exert a stable cleaning performance for a long period of time.

Supposing that an area of the entire wall face of a cell (foam) is S and that the area of an opening portion in the cell wall face is S1, an opening ratio of the cell wall face is calculated by the following equation:

$$\text{Opening ratio of cell wall face}=S1/S\ 100$$

A cell is constituted of a space formed of closed surface in an independent form. A cell has an opening portion at a connecting portion in a form connecting to an adjacent cell. The area of the entire wall face of a cell means a wall surface of the space constituted of closed surface. When a cell has an opening, the area of the entire wall face of the cell means a wall surface of the space constituted of "a closed surface supposed" when the cell exists in an independent form (not connecting to an adjacent cell). The area of an opening portion means an area of the portion constituting the opening in the supposed closed surface.

In an actual calculation, a foam layer is cut and the cut area is exposed and photographed by using a scanning electron microscope (SEM) to obtain a plane photograph.

The areas S and S1 can be calculated from a plane photograph.

The foam roller serving as the second cleaning roller 51B is prepared by forming a foam layer 512B on an outer periphery of a core metal member 511B serving as a shaft member. The second cleaning roller 51B is coupled to a motor (not shown), and disposed so as to be rotatable, while being continuously made in contact with the surface of the intermediate transferring belt 4 in the shaft direction. The second cleaning roller 51B captures and collects objects to be cleaned which were not collected even by the first cleaning brush 51A from the surface of the intermediate transferring belt 4 into its foam layer, while being rotated.

The core metal member 511B is made of metal having a conductive property, and is prepared as a rod member, a pipe, or the like made of, for example, aluminum, iron, stainless, or the like.

In the foam layer 512B, a cell is allowed to communicate with another cell adjacent thereto through opening sections having an appropriate size. For this reason, the above-mentioned opening ratio is achieved. As a result, the foam layer 512B can be deformed more easily than a general foam layer having an independent foam structure so that it is allowed to adhere to the intermediate transferring belt, making it possible to improve scraping properties against objects to be cleaned. It becomes also possible to prevent the surface of the intermediate transferring belt from being damaged (scratches, abrasion, or the like). Since the area of the opening section of the foam layer 512B is smaller than that of a general foam layer having a continuous foam structure, the cleaned objects that are collected hardly permeate into the foam layer. Consequently, clogging hardly occurs in the foam layer, making it possible to maintain the cleaning performance for a long period of time.

A foam material used for forming the foam layer 512B is not particularly limited as long as it allows the foam layer to have the above cell opening ratio, and examples thereof include foamed materials derived from a polyurethane-based resin, a silicone-based resin and a rubber material. The producing method thereof will be described in detail below.

The foam layer 512B generally has a conductive property. The conductivity can be applied thereto by coating the foam layer with a resin solution in which a conductive material is dispersed. The same conductive materials as described above may be used as the conductive material. The volume resistance value of the foam layer is preferably set in a range of approximate $1\ 10^2$ to $1\ 10^8\Omega\cdot$cm. When the volume resistance value is too low, a strong electric field is exerted at a portion having a small contact gap to the intermediate transferring belt to cause a leakage to damage the foam layer and the intermediate transferring belt. In the case when the volume resistance value is too high, the voltage of the second bias-applying means (power supply) needs to be set higher, resulting in problems, such as a high cost and a large size of the power supply device.

The volume resistance value of the foam layer may be measured by an ohm meter (Hiresta®; made by Mitsubishi Yukadenshi Co., Ltd.) by using a method in conformity with JIS-K6199.

Although not particularly limited, the cell diameter of the foam layer 512B is preferably set to 50 μm or more to 1000 μm or less on the average, from the viewpoint of the collecting characteristic for objects to be cleaned. The thickness of the foam layer 512B is generally set to 5 to 30 mm.

A polyurethane foam layer serving as the foam layer 512B is manufactured by a method in which a known mechanical froth method and a known chemical foaming method are combined. The mechanical froth method and the chemical foaming method are common in that polyol and isocyanate are mixed so as to carry out a foaming process. The mechanical froth method carries out a physical foaming process by mixing a foam-forming gas, such as an inert gas, without using a foaming agent as a material. However, the chemical foaming method differs from this method in that a foaming agent is used as a material so that a chemical foaming process is carried out by a chemical reaction between isocyanate and the foaming agent. Upon adopting the mechanical froth method, polyurethane foam having a uniform independent foam structure can be easily manufactured; however, it is difficult to form polyurethane foam having a continuous foam structure with a low density. In contrast, upon adopting the chemical foaming method, polyurethane foam having a continuous foam structure with a low density can be easily manufactured; however, it is difficult to form polyurethane foam having a uniform independent foam structure. The opening ratio of urethane foam having the general independent foam structure produced by a known mechanical froth method or the like is about 1%, while the opening ratio of urethane foam having the general continuous foam structure produced by a known chemical foaming method or the like is about 60%.

In contrast to these conventional manufacturing methods, a manufacturing method for polyurethane foam used in the present invention uses a foaming agent to be used in the chemical foaming method as a material in addition to a polyol, isocyanate and a foam-forming gas to be used in the mechanical froth method. Thus, the physical foaming process by mixing the foam-forming gas and the chemical foaming process according to the chemical reaction by isocyanate and the foaming agent are combined. For this reason, uniform cells, formed by the physical foaming process, are connected to one after another by the chemical foaming process so that polyurethane foam that is uniform and has a low density, that is, polyurethane foam having a continuous foam structure near to the independent foam structure, can be produced. Hereinafter, a specific producing method will be described.

The polyurethane foam used in the present invention is produced through a material-adjusting process, a mixing process and a heating process, in this order from the first process.

In the material-adjusting process, respective materials to be used for producing polyurethane foam are adjusted. As the materials, a polyol, isocyanate, a foam-forming gas such as an inert gas, a foaming agent, and sub-materials such as a catalyst or the like are used.

As the polyol, for example, each of known polyols having an active hydrogen group may be used alone, or two of more kinds of these may be used in combination. Specific examples of the polyols to be used include: polyether polyol, polyester polyol, polycarbonate polyol and polydiene-based polyol.

Specific example of isocyanate include: various kinds of known polyisocyanates of aromatic type, aliphatic type or alicyclic type, such as toluene diphenyl diisocyanate (TDI), TDI prepolymer, methylene diphenyl diisocyanate (MDI), crude MDI, polymeric MDI, urethodion modified MDI and carbodiimide modified MDI.

As the foam-forming gas, for example, nitrogen may be used.

As the foaming agent, those materials that can generate gases through a chemical reaction with isocyanate are used, and more specifically, water or the like may be used. The foaming agent is mixed in the polyol prior to the mixing process.

As the catalyst, for example, an amine-based catalyst and an organic acid-salt based catalyst may be used. The amine-based catalyst is mainly used for accelerating a quick chemical foaming process, and the organic acid-salt based catalyst is mainly used for hardening the skeleton of polyurethane foam. As the organic acid-salt based catalyst, a heat-sensitive catalyst, which exerts a catalyst effect when subjected to a predetermined heating process, is preferably used. With this arrangement, the hardening process of the skeleton of polyurethane foam can be delayed compared to the chemical foaming process carried out by the amine-based catalyst, thereby the chemical foaming process is positively executed.

As the factors that determine the hardness of polyurethane foam, examples thereof include the kind of polyol and isocyanate index. As used herein, the isocyanate index refers to a percentage of a ratio N/M of the mole number N of isocyanate groups of isocyanate relative to the total mole number M of hydroxide groups of a foaming agent and hydroxide groups of a polyol. In an attempt to form polyurethane foam so as to have a hardness in a preferable range of 1 gf/mm or more to 5 gf/mm or less, for example, a polyether polyol or a polyester polyol having a molecular weight of 1000 to 6000 with 2 to 5 functional groups is preferably used as the polyol, and the isocyanate index is preferably set to 90 to 110. The hardness of polyurethane foam is measured through processes in which, a polyurethane foam layer is pushed onto a predetermined pressing face up to a depth corresponding to 30% of the thickness thereof from the surface side (until the thickness of the polyurethane foam layer becomes 70% of an original thickness), the size of a load per unit length received by the pressing face is measured and this represents the hardness. In general, polyurethane foam having an independent foam structure has a hardness of about 8.5 gf/mm, and in general, a polyurethane foam layer having a continuous foam structure has a hardness of about 0.8 gf/mm.

In the case when water is used as the foaming agent, upon mixing the respective materials, carbon dioxide is generated by a chemical reaction between water and isocyanate to form foam (cells). In order to form polyurethane foam having fine cells and a low density, it is necessary to send the carbon dioxide generated by the chemical reaction between water and isocyanate into foam (cells) that is physically generated by a foam-forming gas. In order to achieve this object, the mixing amount of water is preferably adjusted to 0.3 to 1.5 parts by mass relative to 100 parts by mass of the polyol.

In the mixing process, a polyol in which a foaming agent such as water is mixed, isocyanate, a foam-forming gas and a catalyst or the like are mixed with one another. Thus, first, foam is physically generated, and uniform foam (cells) having the foam-forming gas as its nuclei is formed. Thereafter, by allowing the foaming agent contained in the polyol and isocyanate to have a chemical reaction, a gas, such as carbon dioxide, is generated, and this gas is allowed to enter cells formed by the physical foaming process so that the diameter of cells becomes greater as a whole to allow the cells to be mutually joined to one another. Thus, cells that have a large diameter, although they are homogeneous, are generated.

In the heating process, the resin-forming reaction is accelerated by carrying out a predetermined heating treatment on the mixed material so that the skeleton of the polyurethane foam is hardened. The heating temperature and heating time of the heating process are properly determined depending on the materials for the polyurethane foam according to a known mechanical froth method.

With the manufacturing method described above, polyurethane foam having a higher opening ratio of the cell wall face is formed compared to that of polyurethane foam produced by the mechanical froth method. For this reason, since, upon impregnating the polyurethane foam with a solution containing a conductive substance and the like, the solution is easily permeated into the polyurethane foam, it is possible to easily apply functions such as a conductive property thereto.

The polyurethane foam thus produced is fixed onto a core metal member, and by processing into a desired shape, a foam roller is manufactured. If necessary, prior to fixing the core metal member to the polyurethane foam, a process for impregnating the polyurethane foam with the solution containing a conductive substance and the like and a process for drying the urethane foam impregnated with the solution may be carried out.

Although not particularly limited, the rotation direction of the second cleaning roller 51B is preferably set to a direction opposite to the moving direction of the intermediate transferring belt at the contact portion with the intermediate transferring belt, from the viewpoint of the collecting characteristic for objects to be cleaned, as shown in FIG. 2.

The peripheral velocity of the second cleaning roller 51B is determined in accordance with the peripheral velocity of the intermediate transferring belt. More specifically, from the viewpoints of collecting characteristic for objects to be cleaned and durability of the foam layer, the peripheral velocity is desirably determined so that a ratio θb2(Vb2/Va) of a peripheral velocity Vb2 of the second cleaning roller relative to a peripheral velocity Va of the intermediate transferring roller is set to 0.5 or more to 2 or less.

Although not particularly limited, the amount of bite of the second cleaning roller 51B into the intermediate transferring belt is preferably set to 5 to 40% relative to the thickness of the foam layer, from the viewpoints of the collecting characteristic for objects to be cleaned, rotation torque and durability of the foam layer. Generally, the amount of bite is desirably set to 0.5 to 3 mm.

A brush roller serving as the first cleaning roller 51A has a core metal member 511A serving as a shaft member with conductive brush fibers 512A being attached to the outer periphery thereof. More specifically, the conductive brush fibers (raw threads) 512A are knitted into a base cloth itself having a conductive property and/or a base cloth having a conductive material attached to its rear face by a coating process or the like so as to have a conductive property. The base cloth with the conductive brush fibers knitted therein is wound around the core metal member 511A and bonded to each other so as to be conductive to each other. As the bonding method, for example, a bonding method by the use of a conductive bonding agent may be used. A similar conductive material as described earlier may be used as the conductive material.

The first cleaning roller 51A is coupled to a motor (not shown) and disposed so as to be rotatable, while being made in contact with the surface of the intermediate transferring belt 4 in the shaft direction. The first cleaning roller 51A captures and collects objects to be cleaned from the surface of the intermediate transferring belt 4 into its brush fibers, while being rotated.

The core metal member 511A is formed of metal having a conductive property, and is prepared as a rod member, a pipe, or the like made from, for example, aluminum, iron, stainless, or the like.

The material used for forming the conductive brush fibers 512A is not particularly limited, and for example, various materials of nylon type, polyester type, acryl type, rayon type, and the like may be used. Generally, a conductive material is dispersed in the brush fibers 512A so as to apply a conductive property thereto. The similar conductive material as described earlier may be used as the conductive material. The volume resistance value (resistance of raw threads of brush) of the conductive brush fibers 512A is preferably set in an approximate range of $1\ 10^3$ to $1\ 10^{12}\Omega$. When the volume resistance value is too low, a strong electric field is exerted at a portion having a small contact gap to the intermediate transferring belt to cause a leakage to damage the brush and the intermediate transferring belt. In the case when the volume resistance value is too high, the voltage of the first bias-applying means (power supply) needs to be set higher, resulting in problems, such as a high cost and a large size of the power supply device.

The volume resistance value of the conductive brush fibers 512A may be measured by the following method. A fiber to be measured is passed over electrodes spaced apart from each other by 10 cm with a fixed tension being applied thereto, a voltage (V) obtained when a current of 20 μA is applied between the electrodes is measured, and a resistance value (Ω) corresponding to 10 cm in length is calculated.

From the viewpoints of the collecting characteristic and discharging property for objects to be cleaned, and the durability of the intermediate transferring belt, the conductive brush fibers 512A are preferably allowed to have a thickness of 1.1 decitex or more to 11 decitex or less and a brush-planting density of 50 kf/inch$^2$ or more to 300 kf/inch$^2$ or less.

The length of each conductive brush fiber 512A is generally set to 2 to 15 mm. The length of the conductive brush fibers 512A refers to a length from the base portion on the core metal side to the tip of the conductive brush fibers 512A.

Although not particularly limited, the rotation direction of the first cleaning roller 51A is preferably set to a direction opposite to the moving direction of the intermediate transferring belt at the contact portion with the intermediate transferring belt, from the viewpoint of the collecting characteristic for objects to be cleaned, as shown in FIG. 2.

The peripheral velocity of the first cleaning roller 51A is determined according to the peripheral velocity of the intermediate transferring belt. More specifically, from the viewpoints of collecting characteristic for objects to be cleaned and durability of the brush, the peripheral velocity is desirably determined so that a ratio θb1(Vb1/Va) of a peripheral velocity Vb1 of the first cleaning roller relative to the peripheral velocity Va of the intermediate transferring roller is set to 0.5 or more to 2 or less.

Although not particularly limited, the amount of bite of the first cleaning roller 51A into the intermediate transferring belt is preferably set to 10 to 40% relative to the length of the conductive brush fibers 512A, from the viewpoints of the collecting characteristic for objects to be cleaned, rotation torque and durability of the brush. Generally, the amount of bite is desirably set to 0.5 to 3 mm.

A roller made of metal, such as aluminum, stainless and iron, or a roller, prepared by forming a conductive resin layer on the metal roller, is used as the first collecting roller 52A. The first collecting roller 52A further captures and collects the objects captured and collected by the first cleaning roller 51A on its surface. The metal roller may be subjected to a plating process for the purposes of providing smoothness to its surface and of preventing corrosion such as rust. The conductive resin layer is a non-foamed layer, and is formed by dispersing a conductive material in the resin. Although not particularly limited, a material that is superior in abrasion resistance is preferably used as the resin material. Examples of such a preferable resin material include Teflon (registered trademark), polyester, polyvinylidene fluoride, polyamide and polyimide. The similar conductive material as described earlier may be used as the conductive material.

Although not particularly limited, the rotation direction of the first collecting roller 52A is preferably set to the same direction as the rotation direction of the first cleaning roller 51A at the contact portion with the first cleaning roller 51A, from the viewpoint of discharging property of toner, as shown in FIG. 2.

The peripheral velocity of the first collecting roller 52A is determined in accordance with the peripheral velocity of the first cleaning roller. Specifically, from the viewpoints of discharging property from the first cleaning roller and durability of the foam layer, the peripheral velocity is desirably determined so that a ratio θc1(Vc1/Vb1) of a peripheral velocity Vc1 of the first collecting roller 52A relative to the peripheral velocity Vb1 of the first cleaning roller is set to 0.5 or more to 1.5 or less.

Although not particularly limited, the amount of bite of the first cleaning roller 51A into the first collecting roller 52A is preferably set to 10 to 40% relative to the length of the conductive brush fibers 512A, from the viewpoints of toner discharging property and durability of the brush. Generally, the amount of bite is preferably set to 0.5 to 3 mm.

A first blade 53A is a member used for scraping objects to be cleaned on the first collecting roller 52A, and an elastic member is made in contact with the surface of the first collecting roller 52A. As the component material for the first blade 53A, for example, metal, such as stainless, copper and aluminum, and elastmer, such as silicone rubber and urethane rubber, can be used.

The first blade 53A is fixed and disposed at a contact portion with the first collecting roller 52A in a manner so as to oppose the rotation direction of the collecting roller.

The first bias-applying means 56A is a DC power supply for applying a bias voltage to the first cleaning roller 51A, and may directly apply bias voltage to the first cleaning roller 51A. However, in the case when the first collecting roller 52A is installed, the bias voltage may be applied to the first cleaning roller 51A through the first collecting roller 52A, as shown in FIG. 2.

The bias voltage applied to the first bias-applying means 56A may have the same polarity as the toner-charged polarity at the time of developing, or may have the opposite polarity. However, from the viewpoint of the collecting characteristic for objects to be cleaned, the bias voltage is preferably made to have the same polarity as the toner-charged polarity at the time of developing.

The first bias-applying means 56A may be either a constant voltage power supply or a constant current power supply, and in the case of the constant voltage power supply, it is set to, for example, 10 kV or less, and in the case of the constant current power supply, it is set to, for example, 100 μA or less.

The roller similar to the first collecting roller 52A may be used as the second collecting roller 52B, and the second collecting roller 52B further captures and collects on its surface objects to be cleaned which are captured and collected by the second cleaning roller 51B. The second collecting roller 52B may be selected independently from the first collecting roller 52A.

Although not particularly limited, the rotation direction of the second collecting roller 52B is preferably set to the same direction as the rotation direction of the second cleaning roller 51B at the contact portion with the second cleaning roller 51B, from the viewpoint of discharging property from the foam roller, as shown in FIG. 2.

The peripheral velocity of the second cleaning roller 52B is determined according to the peripheral velocity of the second cleaning roller. Specifically, from the viewpoints of the collecting characteristic for objects to be cleaned and durability of the foam layer, the peripheral velocity is desirably determined so that a ratio θc2(Vc2/Vb2) of a peripheral velocity Vb2 of the second cleaning roller 52B relative to the peripheral velocity Vb2 of the second cleaning roller is set to 0.5 or more to 1.5 or less.

Although not particularly limited, the amount of bite of the second cleaning roller 51B into the second collecting roller 52B is preferably set to 10 to 40% relative to the thickness of the foam layer, from the viewpoints of the collecting characteristic for objects to be cleaned, rotation torque, and durability of the foam layer. Generally, the amount of bite is desirably set to 0.5 to 3 mm.

A second blade 53B is a member used for scraping objects to be cleaned on the second collecting roller 52B, and a member having an elastic property is made in contact with the surface of the second collecting roller 52B. As the component material for the second blade 53B, the similar material as that of the first blade 53A may be used, and may be selected independently from the first blade 53A The second blade 53B is fixed and disposed at a contact portion with the second collecting roller 52B in a manner so as to oppose the rotation direction of the collecting roller.

The second bias-applying means 56B is a DC power supply for applying a bias voltage to the second cleaning roller 51B, and may directly apply bias voltage to the second cleaning roller 51B. However, in the case when the second collecting roller 52B is installed, the bias voltage may be applied to the second cleaning roller 51B through the second collecting roller 52B, as shown in FIG. 2.

The bias voltage to be applied to the second bias-applying means 56B is a bias voltage having the polarity different from that of the bias voltage applied by the first bias-applying means 56A.

The second bias-applying means 56B may be either a constant voltage power supply or a constant current power supply, and in the case of the constant voltage power supply, it is set to 10 kV or less, and in the case of the constant current power supply, it is set to 100 μA or less.

In the cleaning device 50, the first cleaning roller 51A, the second cleaning roller 51B, the first collecting roller 52A, the second collecting roller 52B and the intermediate transferring belt are designed to be independently driven to rotate by driving devices. The respective driving devices are allowed to control the rotation speed or moving speed by the control device.

In the cleaning device 50 of the present invention, description will be made of operations for collecting and removing residual toner included as a main component of objects to be cleaned. The other components included in the objects to be cleaned are also collected and removed in the similar manner as in the residual toner.

For example, in the case when a bias voltage having the same polarity as the toner-charged polarity at the time of developing is applied to the first cleaning roller by the first bias-applying means, with respect to residual toner on the surface of the intermediate transferring belt 4, first, the oppositely polarized toner charged to a polarity opposite to the toner-charged polarity at the time of developing is electrostatically collected by the first cleaning roller 51A. Thereafter, the second cleaning roller 51B, prepared as a foam roller, is allowed to collect toner that has been charged to the toner-charged polarity at the time of developing by a bias voltage applied by the second bias-applying means, and also mechanically scrapes off and collects the oppositely polarized toner that the first cleaning roller has failed to collect.

For example, in the case where a bias voltage having a polarity opposite to the toner-charged polarity at the time of developing is applied to the first cleaning roller by the first bias-applying means, with respect to residual toner on the surface of the intermediate transferring belt 4, first, the regularly polarized toner charged to the same polarity as the toner-charged polarity at the time of developing is electrostatically collected by the first cleaning roller 51A. Thereafter, the second cleaning roller 51B, prepared as a foam roller, is allowed to collect oppositely polarized toner that has been charged to a polarity opposite to that of the toner-charged polarity at the time of developing by a bias voltage applied by the second bias applying means, and also mechanically scrapes off and collects the regularly polarized toner that the first cleaning roller has failed to collect.

Thereafter, in both of the cases, the toners collected by the first cleaning roller 51A and the second cleaning roller 51B are respectively further electrostatically collected by the first collecting roller 52A and the second collecting roller 52B. The toners collected by the first collecting roller 52A and the second collecting roller 52B are respectively scraped off mechanically by the first blade 53A and the second blade 53B, and transported to a container or the like (not shown) by a transporting screw 54.

Figure 3:
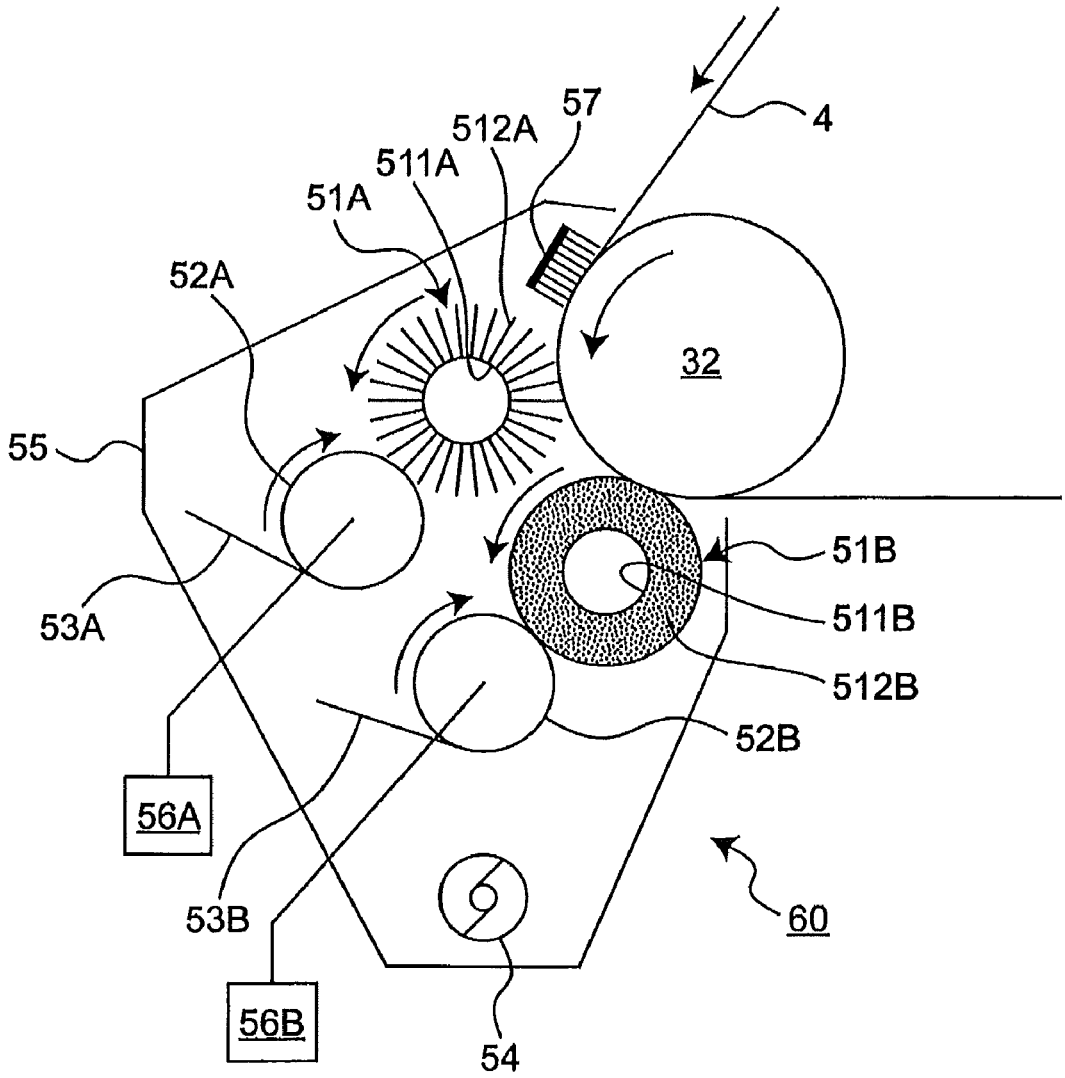
FIG. 3 is an enlarged view showing a cleaning device for an intermediate transferring member according to another embodiment of the present invention.

FIG. 3 shows another embodiment of a cleaning device. A cleaning device 60 shown in FIG. 3 has the similar structure as that of the cleaning device shown in FIG. 2 except that it is further provided with a brush 57. Therefore, the description thereof will not be given unless otherwise specified. In FIG. 3, those members denoted by the same reference numerals as those in FIG. 2 are the same as those members having the corresponding reference numerals in FIG. 2.

The brush 57 is disposed so as to be made in contact with the surface of the intermediate transferring belt on the upstream side from the first cleaning roller 51A in the surface-moving direction of the intermediate transferring belt 4. Among objects to be cleaned on the intermediate transferring belt, paper powder contains particles having a size much larger than the size of the toner, which causes degradation of the first cleaning roller 51A. However, by collecting and removing the paper powder by the use of the brush 57, it is possible to obtain stable cleaning performances for a longer period of time.

The brush 57 has the similar structure as that of the second cleaning roller 51B, except that the shape thereof is not particularly limited.

The shape of the brush 57 is prepared as, for example, a flat plate shape, a roller shape, or the like.

(Image-Forming Apparatus)

FIG. 1 shows a schematic configuration of one embodiment of an image-forming apparatus according to the present invention. An image-forming apparatus 100 of FIG. 1 is an image-forming apparatus of an electrophotographic system, which corresponds to a full-color image-forming apparatus of a tandem type. However, the present invention is not limited thereto, and for example, a full-color image-forming apparatus of a so-called cycle type, or a mono-color image-forming apparatus may be used.

The image-forming apparatus 100 includes an intermediate transferring belt 4 that is wound around rollers 31, 32 and 33, and driven to rotate in an anticlockwise direction (direction indicated by an arrow in the figure) in the figure. In this case, the intermediate transferring belt 4 has a shape of an endless belt, however, an intermediate transferring drum having a drum shape may also be used.

A cleaning device 50 that cleans objects to be cleaned, such as residual toner, on the intermediate transferring belt 4 is made to face the roller 32. The cleaning device 50 for the intermediate transferring belt has been described above. A secondary transfer member 6 is made to face the roller 31. The secondary transfer member 6 is prepared as a secondary transfer roller 6 in a roller form. A fixing device 7 is placed above the secondary transfer roller 6.

Between the rollers 32 and 31, a yellow image-forming unit Y, a magenta image-forming unit M, a cyan image-forming unit C and a black image-forming unit K are disposed in this order from the roller 32 toward the roller 31 along the intermediate transferring belt 4. Each image-forming unit includes a drum-shaped photosensitive member 11 serving as an electrostatic latent image-supporting member, and on the periphery of the photosensitive member, provided are a charging device 12, an image-exposing device 13, a developing device 14, a primary transfer member 2, and a cleaning device 15 for removing objects to be cleaned such as residual toner on the photosensitive member, in this order. A primary transfer member 2 is prepared as a primary transfer roller 2 in a roller form, and is disposed to face the photosensitive member 1 with the intermediate transferring belt 4 interposed in between.

Each of the developing devices 14 in the respective image-forming units uses a negatively chargeable toner, and inversion-develops an electrostatic latent image formed on the photosensitive member 11. The toner is not limited to those having a negatively charged property, but may also have a positively charged property. The developing system is not limited to the inversion developing system, but may also be a regular developing system. In each image-forming unit, the photosensitive member 11, the charging device 12, the image-exposing device 13, the developing device 14 and the cleaning device 15 are attached to a single case 1 and held thereto, and the photosensitive member 11 is made to face the transferring belt 4 from the case 1, and made in contact with the transferring belt 4.

Feeding cassettes 8 for recording media (recording paper S in the present embodiment) are placed below the four image-forming units Y, M, C and K, and sheets of paper S housed therein are drawn by a feeding roller 81 one by one so as to be supplied.

A predetermined high voltage used for charging the photosensitive member is applied to the charging device 12 of each of the image-forming units from a power supply (not shown) at a predetermined timing, upon instruction from a control unit Cont (not shown). A predetermined developing bias voltage is applied to the developing roller 141 of the developing device 14 of each of the image-forming units from a developing bias power supply (not shown) at a predetermined timing, upon instruction from the control unit Cont.

A primary transfer voltage is applied to the primary transfer roller 2 from a primary transfer power supply for an image-forming unit (not shown) upon instruction from the control unit Cont, at a predetermined timing in which a toner image on the photosensitive drum 11 is primarily transferred onto the intermediate transferring belt 4.

A secondary transfer voltage is applied to the secondary transfer roller 6 from a power supply (not shown) upon instruction from the control unit Cont, at a timing in which the toner image on the intermediate transferring belt 4 is secondarily transferred onto the recording sheet S.

In each of the image-forming units, operations of the rotation members, such as the photosensitive member 11, the primary transfer roller 2 and the developing roller 141 in the developing device 14, and the image-exposing device 13, as well as operations of the secondary transfer roller 6, the driving roller 31 of the rollers over which the intermediate transferring belt 4 is wound, the fixing device 7, the paper-feeding roller 81 and the cleaning devices 50 and 15, are executed at predetermined timings upon instruction of the control unit CONT.

The image-forming apparatus 100 carries out image-forming processes as described below.

First, an image-forming process is carried out in at least one of the image-forming units Y, M, C and K according to an image to be finally formed. For example, upon forming a full-color image by using all the image-forming units Y, M, C and K, first, a yellow toner image is formed in the yellow-image-forming unit Y, and the formed image is primarily transferred onto the intermediate transferring belt 4. That is, the photosensitive member 11 is driven to rotate in the clockwise direction in the figure in the yellow-image-forming unit Y so that the surface of the photosensitive member 11 is uniformly charged to a predetermined potential by the charging device 12, and an imaging exposure for a yellow image is applied to the charged area by the image-exposing device 13 to form a yellow-based electrostatic latent image on the photosensitive member 11. This electrostatic latent image is developed by the developing roller 141 to which a developing bias voltage is applied in the developing device 14 having a yellow toner so that a visible yellow toner image is formed, and the toner image is transferred onto the intermediate transferring belt 4 by the primary transfer roller 2 to which a primary transfer voltage is applied. In the similar manner, a magenta toner image is formed in the magenta image-forming unit M, and transferred onto the intermediate transferring belt 4, a cyan toner image is formed in the cyan image-forming unit C, and transferred onto the intermediate transferring belt 4, and a black toner image is formed in the black image-forming unit K, and transferred onto the intermediate transferring belt 4. The yellow, magenta, cyan and black toner images are formed at respective timings so as to be transferred and superposed on the intermediate transferring belt 4. Thus, the multiple toner image formed on the intermediate transferring belt 4 is moved toward the secondary transfer roller 6 by the rotation of the intermediate transferring belt 4.

A sheet of recording paper S is drawn by the paper-feeding roller 81 from the recording paper feeding cassette 8, and successively supplied between the intermediate transferring belt 4 and the secondary transfer roller 6 in synchronism with the multiple toner image on the belt 4 by a pair of timing rollers 91 and 92 so that the multiple toner image is secondarily transferred onto the recording paper S by the secondary transfer roller 6 to which a secondary transfer voltage is applied. Thereafter, the recording paper S is allowed to pass through the fixing device 7 in which the multiple toner image is fixed onto the recording paper S under applied heat and pressure to form a predetermined color image on the recording paper S. Thereafter, the recording paper S is discharged onto a discharged paper tray T by a pair of paper-discharging rollers R.

After the primary transferring process in each of the image-forming units, objects to be cleaned, such as residual toner derived from the primary transfer, remaining on the photosensitive member 11, are cleaned and collected by the cleaning device 15. After the secondary transferring process, objects to be cleaned, such as residual toner derived from the secondary transfer, remaining on the intermediate transferring belt 4, are cleaned and collected by the cleaning device 50. After the primary transferring process, most of the objects remaining on the photosensitive member 11 or adhered thereto, is residual toner derived from the primary transfer. However, objects remaining on the belt 4 or adhered thereto after the secondary transferring process include paper powder derived from the recording paper S, filling materials for the recording paper (talc etc.) and the like, in addition to residual toner derived from the secondary transfer. In the case when the developing device 14 uses a two-component developer in the image-forming unit, carrier contained in the two-component developer may also be adhered thereto.

EXAMPLES

Production of Brush Roller A

Conductive nylon fibers (size: 220T/96F, raw thread resistance: 1 $10^{12}\Omega$, made by Unitika, Ltd.) were knitted together with a clothing fabric material to form a brush material having a fiber density of 240 KF/inch$^2$, and a member prepared by coating the rear face of the brush materia with a conductive paint was wrapped around a core metal member (outer diameter: 11 mm), and was further subjected to a cutting process so as to have an outer diameter of $\phi$18.5 mm; thus, a brush roller A was obtained.

Production of Brush Roller B

By using the similar method as that of the brush roller A except that a brush material having a fiber density of 140 KF/inch$^2$ was formed by the use of conductive polyester (size: 330T/48F, and raw thread resistance: 1 $10^3\Omega$, made by KB Seiren Ltd.), a brush roller B was obtained.

Production of Foam Rollers C to G

Predetermined foam layers were fixed to core metal members (outer diameter: 8.0 mm), and were subjected to cutting processes so as to have an outer diameter of 18.5 mm; thus, foam rollers C to G were obtained.

Foam layers 1 to 5, shown in Table 1, were used as the foam layers. Each of the foam layers 1 to 5 was produced with the method described in the embodiments by using polyol, isocyanate, an amine-based catalyst, an organic acid-salt based catalyst, water (foaming agent), a foam-forming gas and a foam-adjusting material as raw materials. More specifically, a polyether polyol (trade name: Actcol ED-37B (number-average molecular weight: 3000, made by Mitsui Takeda Chemicals, Inc.) was used as the polyol, methylene diphenyldiisocyanate (MDI)(trade name: Millionate® MLT-S, made by Japan Polyurethane Co., Ltd.) was used as the isocyanate. A Kaolizer No. 23NP, made by Kao Corporation, was used as the amine-based catalyst. An EP73660A, made by PAN TECHNOLOGY, Inc., was used as the organic acid-salt based catalyst. A nitrogen gas was used as the foam-forming gas. A nitrogen gas of 100 ml per 100 ml of the materials was blown thereto.

Straight-chain dimethyl polysiloxane (trade name: Niax® silicone L5614, made by GE Silicones, Inc.) was used as the foam-adjusting agent. The amounts of use of the respective materials were set as shown in a table below. In order to apply a conductive property to the foam layer, after the foam layer was immersed in and impregnated with a solution with carbon black and a binder resin dispersed therein, and dried so that volume resistance values of all samples was adjusted to about 1 $10^3$ to 1 $10^8\Omega\cdot$cm.

TABLE 1

| | | Foam layer 1 | Foam layer 2 | Foam layer 3 | Foam layer 4 | Foam layer 5 |
|---|---|---|---|---|---|---|
| Material | Polyol (parts by weight) | 110 | 110 | 110 | 110 | 110 |
| | Isocyanate (parts by weight) | 30.4 | 30.8 | 31.8 | 33.2 | 33.9 |
| | Amine catalyst (parts by weight) | 0.29 | 0.31 | 0.33 | 0.32 | 0.38 |

TABLE 1-continued

| | | Foam layer 1 | Foam layer 2 | Foam layer 3 | Foam layer 4 | Foam layer 5 |
|---|---|---|---|---|---|---|
| | Organic acid catalyst (parts by weight) | 4.2 | 4.2 | 4.2 | 4.2 | 4.2 |
| | Water (parts by weight) | 0.9 | 1 | 1.1 | 1.1 | 1.2 |
| | Foam adjusting material (parts by weight) | 9.3 | 9.3 | 9.3 | 9.3 | 9.3 |
| Physical property | Average cell diameter (μm) | 280 | 300 | 290 | 280 | 270 |
| | Cell wall aperture ratio (%) | 2 | 5 | 15 | 50 | 55 |
| Foam roller No. | | Foam roller C | Foam roller D | Foam roller E | Foam roller F | Foam roller G |
| Roller physical property | Volume resistance value (Ω · cm) | $1 \times 10^5$ | $1 \times 10^3$ | $1 \times 10^5$ | $1 \times 10^8$ | $1 \times 10^5$ |

A method for measuring physical property values of the foam layers 1 to 5 will now be described.

With respect to the average cell diameter, a cut face of a foam member was observed by a scanning electronic microscope (SEM) so that measurements were carried out. From a photographed image, 100 cells were selected at random, and the average of the respective cell diameters was calculated.

With respect to the opening ratio, a cut face of a foam member was observed by the scanning electronic microscope (SEM) in the similar manner so that measurements were carried out. The total area S of the photographed image area and a sum S1 of the areas of the openings on a cell wall face were calculated, and an opening ratio (S1/S 100) was found.

Example/Comparative Example; Evaluation

Upon evaluation, a modified machine of a Bizhub C450 (made by Konica Minolta Holdings, Inc.) was used. Unless otherwise specified, the standard conditions of the printer were adopted in the following description. More specifically, a pre-charging brush portion of the cleaning device of the intermediate transferring belt was modified so that, as shown in FIG. 2, the predetermined first cleaning roller 51A, first collecting roller 52A, and first blade 53A were attached thereto. To the original position of the cleaning brush, as shown in FIG. 2, the predetermined second cleaning roller 51B, second collecting roller 52B, and second blade 53B were attached.

The rollers described in Table 2 were respectively used as the first cleaning roller 51A and the second cleaning roller 51B.

Nickel-plated rollers made of SUS were used as the first collecting roller 52A and the second collecting roller 52B. The thickness of the plated film was 10 μm and the diameter of the core metal member was ϕ12 mm.

A thin plate made of SUS (thickness: 80 μm) was used as each of the first blade 53A and the second blade 53B.

Negatively chargeable cyan toner having an average particle size of 6.5 microns was used as the toner.

A belt (surface resistivity: $5\ 10^{11}\Omega$) formed of a conductive polyimide resin was used as the intermediate transferring belt 4, and the belt velocity was set to 300 mm/second.

Each of the amount of bite of the first cleaning roller 51A into the intermediate transferring belt 4 and the amount of bite of the second cleaning roller 51B into the intermediate transferring belt 4 was set to 1.3 mm.

Each of the amount of bite of the first cleaning roller 51A into the first collecting roller 52A and the amount of bite of the second cleaning roller 51B into the second collecting roller 52B was set to 1.3 mm.

Each of the rotation velocities of the first cleaning roller 51A, the second cleaning roller 51B, the first collecting roller 52A and the second collecting roller 52B was set to 300 mm/second, and the rotation directions of these rollers are respectively shown in FIG. 2.

The first collecting roller 52A and the second collecting roller 52B were designed so that cleaning electric fields were respectively applied thereto from external power supplies 56A and 56B, and a shaft portion of the driving roller 32 was processed so as to be grounded (earthed).

A bias voltage was applied to the first cleaning roller 51A through the first collecting roller 52A. A constant current power supply of minus 40 μA was used as the power supply 56A used for applying the bias voltage.

A bias voltage was applied to the second cleaning roller 51B through the second collecting roller 52B. A constant current power supply of plus 30 μA was used as the power supply 56B used for applying the bias voltage.

Cleaning Performance

In order to evaluate the cleaning performance, an initial state and a state during endurance operations were evaluated. Upon evaluating the state during endurance operations, those members that was subjected to printing operations of 100,000 sheets of an image with a B/W ratio of 5% so as to accelerate deterioration of the members were used.

An image density was set to gradation 255/255 as the highest setting, with a primary transferring current being set to 30 μV and a secondary transferring bias being set to zero (μA). In this state, an A-4 solid image was outputted. The residual toner on the intermediate transferring belt after the cleaning process by using the cleaning device set under the above-mentioned conditions was measured.

The residual toner after the cleaning process on the intermediate transferring belt was transferred onto a booker tape (3 cm in width 25 cm in length) and was pasted onto base paper. The residual toner after the cleaning process was picked up from the far side, the frontward side and the center along the belt width. A new booker tape was pasted onto the same base paper, and used as a reference. The color of the booker tape was measured by using a CM-512mk3 (spectrocolorimetric device, made by Konica Minolta Sensing, Inc.) so that a color difference from the reference was obtained. The measurements were carried out at three portions, that is, the leading end, the center and the rear end on the booker tape in the belt-moving direction so that color differences at nine portions were measured under the respective conditions.

Figure 4:
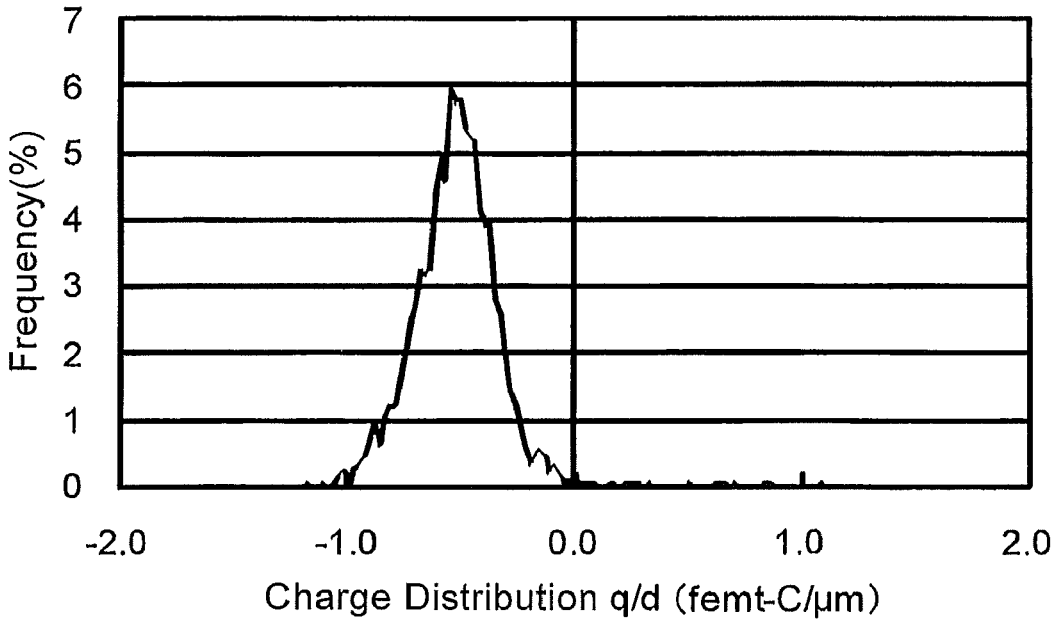
FIG. 4 is an example of a distribution of quantity of charge in residual toner after a transferring process in the case when a secondary transferring bias is set to zero.
Figure 5:
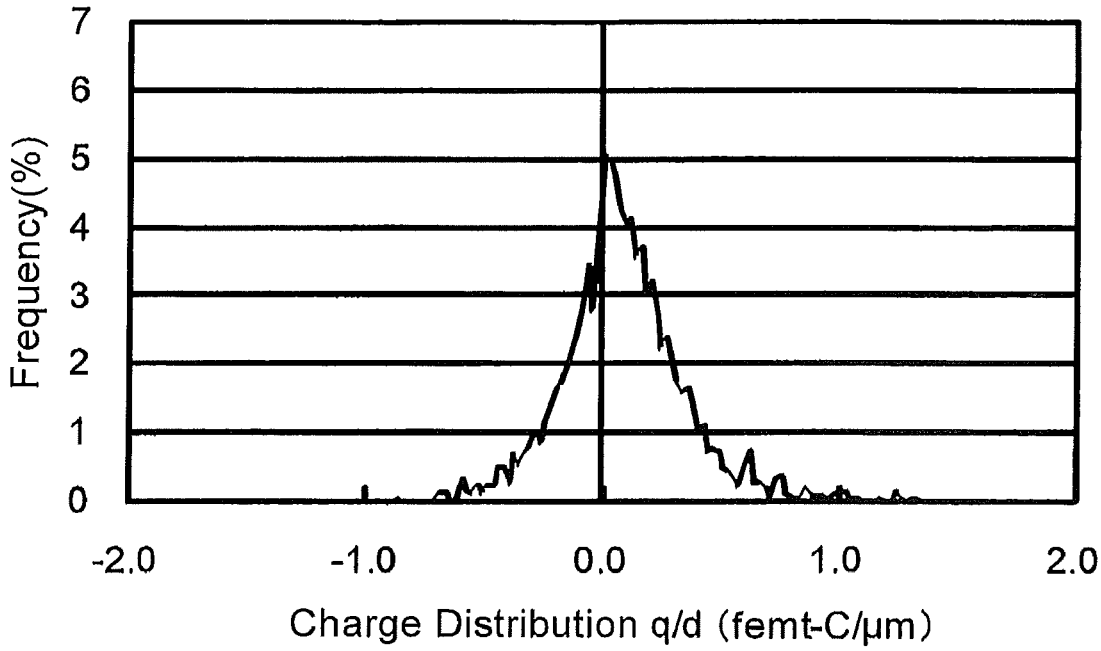
FIG. 5 is a distribution of quantity of charge in residual toner after a transferring process in the case when a secondary transferring bias voltage is set so as to exert a current value of 16 μA, and applied thereto.
Figure 6:
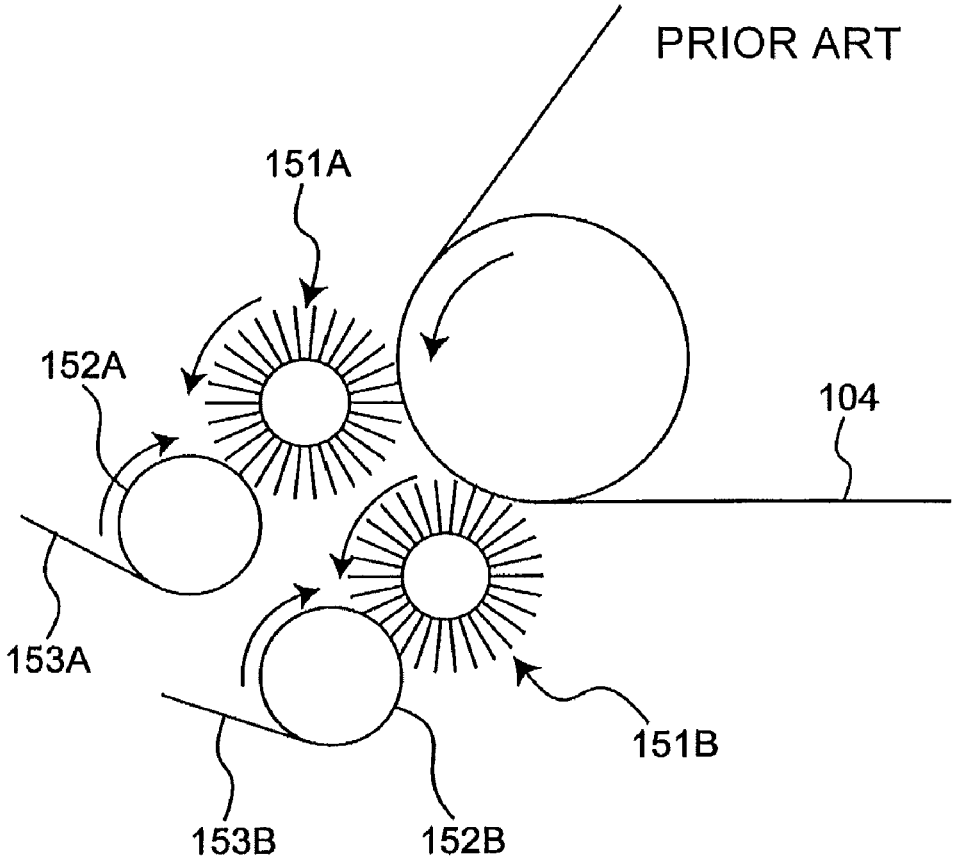
FIG. 6 is an enlarged view showing a conventional cleaning device for an intermediate transferring member.

The above-mentioned measurements were carried out also in the case when the secondary transfer bias voltage was set so as to provide an electric current value of 60 μA. When the secondary transfer bias voltage was zero (μA), the quantity of charge of residual toner after the transferring process showed a distribution on the negative charged side, as shown in FIG. 4. In contrast, when the secondary transfer bias voltage was 60 μA, both of positively charged toner and negatively charged were present as shown in FIG. 5. In FIGS. 4 and 5, the distribution of the quantity of charge of the toner was measured by using an E-SPART analyzer (made by Hosokawa Micron Corp.).

Upon determination, when the color difference ΔE after the cleaning process was 0.7 or less at all the 18 portions (2 conditions of secondary transfer current 9 portions on the belt), this state was evaluated as "superior (○)", while in the case when the color difference ΔE exceeded 0.7 even at one portion, this state was evaluated as "failure (x)".

TABLE 2

| | First cleaning roller | Second cleaning roller | Cleaning performance Initial | Cleaning performance After printing 100,000 sheets |
|---|---|---|---|---|
| Comparative Example 1 | Brush roller A | Brush roller A | x | x |
| Comparative Example 2 | Brush roller B | Brush roller B | x | x |
| Comparative Example 3 | Brush roller A | Foam roller C | x | x |
| Example 1 | Brush roller A | Foam roller D | ○ | ○ |
| Example 2 | Brush roller A | Foam roller E | ○ | ○ |
| Example 3 | Brush roller A | Foam roller F | ○ | ○ |
| Comparative Example 4 | Brush roller A | Foam roller G | ○ | x |
| Comparative Example 5 | Brush roller B | Foam roller C | x | x |
| Example 4 | Brush roller B | Foam roller D | ○ | ○ |
| Example 5 | Brush roller B | Foam roller E | ○ | ○ |
| Example 6 | Brush roller B | Foam roller F | ○ | ○ |
| Comparative Example 6 | Brush roller B | Foam roller G | ○ | x |

With respect to the combination between the first cleaning roller and the second cleaning roller, a combination of a brush roller and a foam roller made it possible to improve the cleaning performance. Moreover, it was found that, when the opening ratio of the cell wall face of the foam roller was set to 5% or more to 50% or less, an appropriate collecting characteristic was maintained even after the endurance operations.

When the cleaning device after the endurance operations was observed, paper powder in a fiber state was adhered to the first cleaning roller. Therefore, a flat plate brush 57 was attached onto the upstream side of the first cleaning roller 51A as shown in FIG. 3, and the endurance evaluation was carried out by using the similar method as that of the above-mentioned example.

Upon preparing the flat plate brush 57, a cloth with nylon brush (size: 330T/48F, fiber density: 80 KF/inch$^2$, brush width: 8 mm, made by Unitika, Ltd.) was pasted to the housing of the cleaning device by using a double-sided adhesive tape.

As a result, in Examples 1 to 6, fiber-state paper powder was collected by the attached flat plate, and no adhesion of paper powder to the first cleaning roller was observed so that it was possible to further appropriately maintain the cleaning performance.

INDUSTRIAL APPLICABILITY

The cleaning device of the present invention can clean the surface of an intermediate transferring member in an image-forming apparatus, such as a copying machine, a facsimile and a laser printer, of an electro-photographic system that forms monochrome images or color images, effectively for a long period of time.

What is claimed is:

1. A cleaning device for an intermediate transferring member, comprising:

a first cleaning roller that is placed so as to rotate while being made in contact with a surface of the intermediate transferring member;

a first bias-applying means that applies a bias voltage to the first cleaning roller;

a second cleaning roller that is placed so as to rotate while being made in contact with the surface of the intermediate transferring member on a downstream side from the first cleaning roller in a surface-moving direction of the intermediate transferring member; and a second bias-applying means that applies a bias voltage having a polarity different from that of the bias voltage applied by the first bias-applying device to the second cleaning roller, wherein the first cleaning roller is a brush roller, and the second cleaning roller is a foam roller having a foam layer on a surface thereof, with a cell wall face in the foam layer having an opening ratio in a range of 3% or more to 50% or less.

2. The cleaning device according to claim 1, wherein the bias voltage applied by the first bias-applying device is the same polarity as the polarity of charged toner on the surface of the intermediate transferring member upon developing.

3. The cleaning device according to claim 1, further comprising:

a first collecting roller disposed so as to be rotatable while being made in contact with the surface of the first cleaning roller;

a first blade that is fixed and disposed while being made in contact with the surface of the first collecting roller;

a second collecting roller disposed so as to be rotatable while being made in contact with the surface of the second cleaning roller; and a second blade that is fixed and disposed while being made in contact with the surface of the second collecting roller;

wherein the bias voltage by the first bias-applying device is applied to the first cleaning roller through the first collecting roller, and the bias voltage by the second bias-applying device is applied to the second cleaning roller through the second collecting roller.

4. The cleaning device according to claim 1, further comprising:

a brush being disposed so as to be made in contact with the surface of the intermediate transferring belt on the upstream side from the first cleaning roller in the surface-moving direction of the intermediate transferring belt.

5. The cleaning device according to claim 1, wherein the foam layer has a volume resistance value in a range of $1\times10^2$ to $1\times10^8\Omega\cdot$cm.

6. The cleaning device according to claim 1, wherein the foam layer has an average cell diameter in a range of 50 μm or more to 1000 μm or less.

7. The cleaning device according to claim 1, wherein each cell in the cell wall face of the foam layer communicates with an adjacent cell in the cell wall face trough an opening section.

8. An image-forming apparatus, comprising:

a cleaning device for an intermediate transferring member, comprising:

a first cleaning roller that is placed so as to rotate while being made in contact with a surface of the intermediate transferring member;

a first bias-applying device that applies a bias voltage to the first cleaning roller;

a second cleaning roller that is placed so as to rotate while being made in contact with the surface of the intermediate transferring member on a downstream side from the first cleaning roller in a surface-moving direction of the intermediate transferring member; and a second bias-applying device that applies a bias voltage having a polarity different from that of the bias voltage applied by the first bias-applying device to the second cleaning roller, wherein the first cleaning roller is a brush roller, and the second cleaning roller is a foam roller having a foam layer on a surface thereof, with a cell wall face in the foam layer having an opening ratio in a range of 3% or more to 50% or less.

9. The image-forming apparatus according to claim 8, wherein the bias voltage applied by the first bias-applying device is the same polarity as the polarity of charged toner on the surface of the intermediate transferring member upon developing.

10. The image-forming apparatus according to claim 8, further comprising:

a first collecting roller disposed so as to be rotatable while being made in contact with the surface of the first cleaning roller;

a first blade that is fixed and disposed while being made in contact with the surface of the first collecting roller;

a second collecting roller disposed so as to be rotatable while being made in contact with the surface of the second cleaning roller; and a second blade that is fixed and disposed while being made in contact with the surface of the second collecting roller;

wherein the bias voltage by the first bias-applying device is applied to the first cleaning roller through the first collecting roller, and the bias voltage by the second bias-applying device is applied to the second cleaning roller through the second collecting roller.

11. The image-forming apparatus according to claim 8, further comprising:

a brush being disposed so as to be made in contact with the surface of the intermediate transferring belt on the upstream side from the first cleaning roller in the surface-moving direction of the intermediate transferring belt.

12. The image-forming apparatus according to claim 8, wherein the foam layer has a volume resistance value in a range of $1\times10^2$ to $1\times10^8\Omega\cdot$cm.

13. The image-forming apparatus according to claim 8, wherein the foam layer has an average cell diameter in a range of 50 μm or more to 1000 μm or less.

14. The image-forming apparatus according to claim 8, wherein each cell in the cell wall face of the foam layer communicates with an adjacent cell in the cell wall face trough an opening section.

* * * * *